United States Patent [19]

Brewster

[11] 4,070,579

[45] Jan. 24, 1978

[54] X-RAY TUBE TRANSFORMER

[75] Inventor: John La Due Brewster, Dundee, Oreg.

[73] Assignee: Hewlett-Packard Company, Palo Alto, Calif.

[21] Appl. No.: 715,806

[22] Filed: Aug. 19, 1976

[51] Int. Cl.[2] ..... H05G 1/10

[52] U.S. Cl. ..... 250/402; 250/421

[58] Field of Search ..... 250/401, 402, 421, 422, 250/493, 523

[56] References Cited

U.S. PATENT DOCUMENTS

| | | | |
|---|---|---|---|
| 2,365,855 | 12/1944 | Atlee | 250/421 |
| 3,551,677 | 12/1970 | Brewster | 250/402 |
| 3,643,094 | 2/1972 | Courtois | 250/402 |

*Primary Examiner*—Craig E. Church

*Attorney, Agent, or Firm*—Stephen P. Fox

[57] ABSTRACT

A compact impedance transformer increases the magnitude of a voltage pulse applied to an X-ray generator. A transmission line transformer is implemented using a variable impedance spiral delay line to achieve voltage doubling.

7 Claims, 3 Drawing Figures

X-RAY TUBE TRANSFORMER

BACKGROUND OF THE INVENTION

The penetration capabilities of Flash X-ray equipment increase with voltage, particularly for heavy materials such as steel. When protection of the pulse generator or other factors require the use of a remote tubehead, the tube voltage has in the past been limited by the maximum voltage capability of available flexible interconnecting cable. Presently, high voltage flexible cables have characteristic impedances of 60 ohms or less, and should be operated at no more than about 400 kilovolts for reasonable useful cable life.

The desired higher tube voltages at the remote tubehead may be obtained by incorporating a voltage transformer into the tubehead. Previous implementations have used iron core or Tesla-type transformers which substantially increase the size and weight of the tubehead or seriously degrade the pulse waveform characteristics and energy efficiency. Transmission line transformers require an electrical transit time of at least twice the voltage pulse half amplitude width in order to achieve adequate efficiency. This would typically require a transmission line length of over 60 feet for Flash X-ray applications of a transmission line transformer using conventional coaxial cable construction.

SUMMARY OF THE INVENTION

Accordingly, the illustrated embodiment of the present invention increases the voltage of applied voltage pulses at the remote tubehead with a transmission line transformer formed by using a spiral delay line geometry to give a tapered-impedance coaxial high voltage multiplier for pulse voltage operation. This transmission line transformer has a size and weight that are much less than former devices for the same high peak voltage and power ratings.

DESCRIPTION OF THE PREFERRED EMBODIMENT

Figure 1:
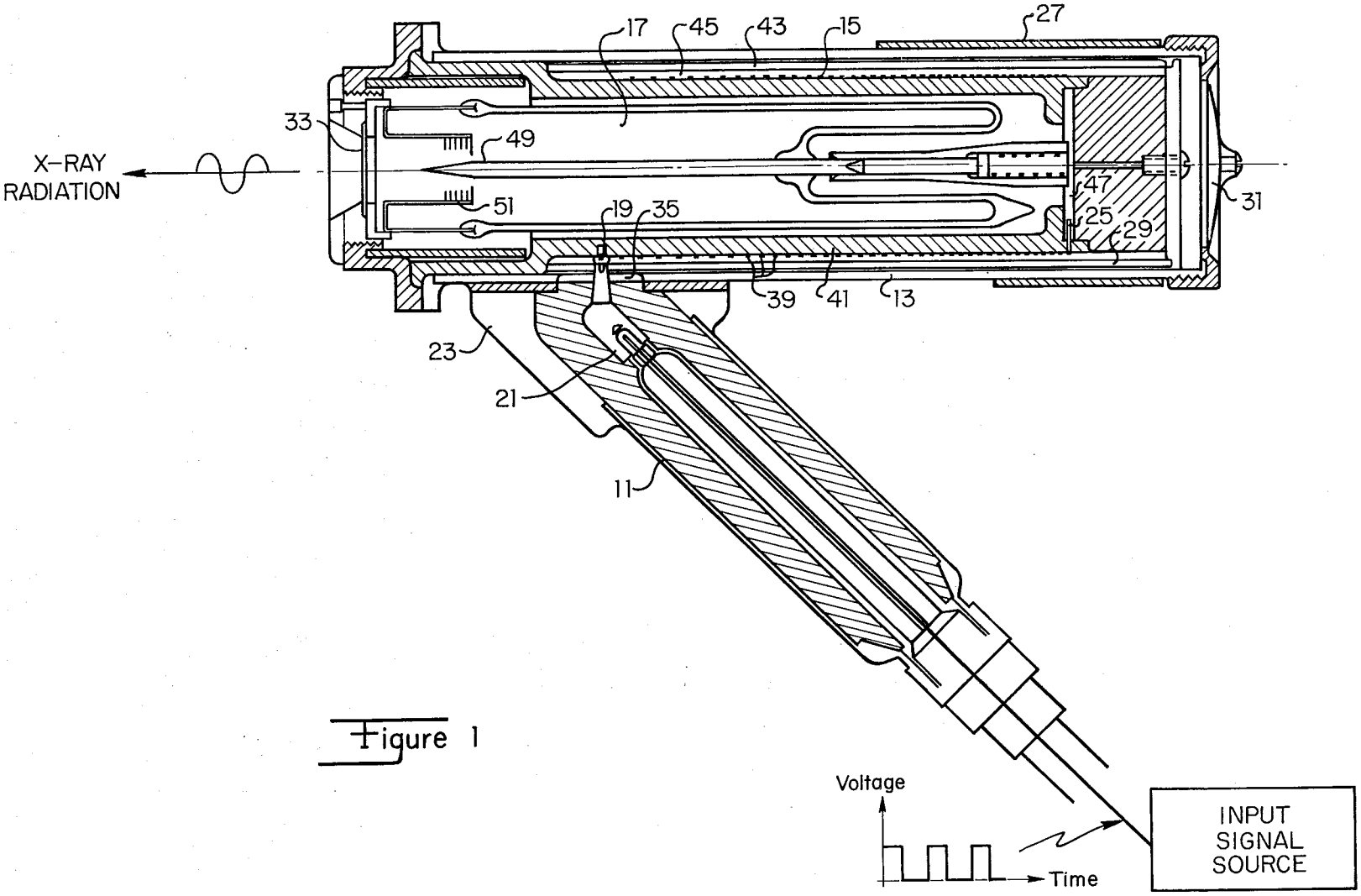
FIG. 1 is a sectional side view illustrating one embodiment of the invention.

Referring to FIG. 1, there is shown an x-ray generator, such as an x-ray tubehead comprising a cable connector 11, a tubehead housing 13, a transmission line transformer 15 and an x-ray tube 17. The cable connector 11 receives an applied high voltage pulsed input signal and conducts the applied signal through the tubehead housing 13 to the transmission line transformer 15. The transmission line transformer 15 provides a voltage multiplied pulsed signal to the x-ray tube 17.

The cable connector 11 has a center conductor 21 coupled to receive the time-variable voltage signal from the center conductor of a coaxial cable and transmits the pulsed voltage signal to a terminal, such as one end of the helix 39 of the transmission line transformer 15. The outer shell 23 of the cable connector 11 and the tubehead housing 13 are electrically insulated from the center conductor 21. The outer shell 23 of the cable connector 11 provides electrical contact between the outer conductor of the coaxial cable and the tubehead housing 13.

The tubehead housing 13 includes an electrically conductive hollow cylindrical aluminum inner housing 29, an aluminum cap 31, an aluminum diaphragm 33 and lead shielding 27. The tubehead housing 13 also includes an insulated aperture 35 through which the center conductor 21 passes. The aluminum inner housing 29 is in electrical contact with the outer shell 23 of the cable connector 11.

The transmission line transformer 15 comprises two electrical conductors, first the aluminum inner housing 29 and second the helix 39. As used in this description and the appended claims, the words helix and helical structure mean a helix having a constant or variable radius and a constant or variable pitch. The helix 39 is wrapped about an insulating spool 41 and disposed within the cavity created by the aluminum inner housing 29. The central axis of the helix 39 is coaxially aligned with the central axis of the cylindrical structure of aluminum inner housing 29. Interposed between the helix 39 and the aluminum inner housing 29 are two dielectric materials comprising a dielectric glass tube 43 and a reservoir 45 of ethylene glycol. The dielectric material electrically insulates the helix 39 from the aluminum inner housing 29 and electro-magnetically couples the two conductors in response to an electric current in the conductors. The pitch of the windings of helix 39 (i.e., the spacing between windings) is decreased along the longitudinal axis of helix 39 from input terminal 19 to output terminal 25. By decreasing the pitch of the windings, the impedance along the transmission line transformer 15 from input terminal 19 to output terminal 25 is increased as a function of the distance along the longitudinal axis of helix 39. The increase in the impedance is primarily the result of the increase in the inductive coupling between adjacent windings as the spacing between the windings decreases. This produces a voltage multiplication along the length of the spiral delay line which is related to the increase in impedance. Voltage doubling of the pulsed signal at the anode 49 of the x-ray tube 17 occurs with a 4:1 increase in the impedance along the transmission line transformer.

Coupled to the transmission line transformer is an x-ray tube, such as a field emission x-ray tube having a tapered anode 49 and a cathode 51 composed of a plurality of closely spaced sharp needle points, for radiating an x-ray wave output. The anode 49 is in electrical contact with helix 39 through anode socket 47 and the cathode 51 is in electrical contact with the aluminum inner housing 29.

Figure 2:
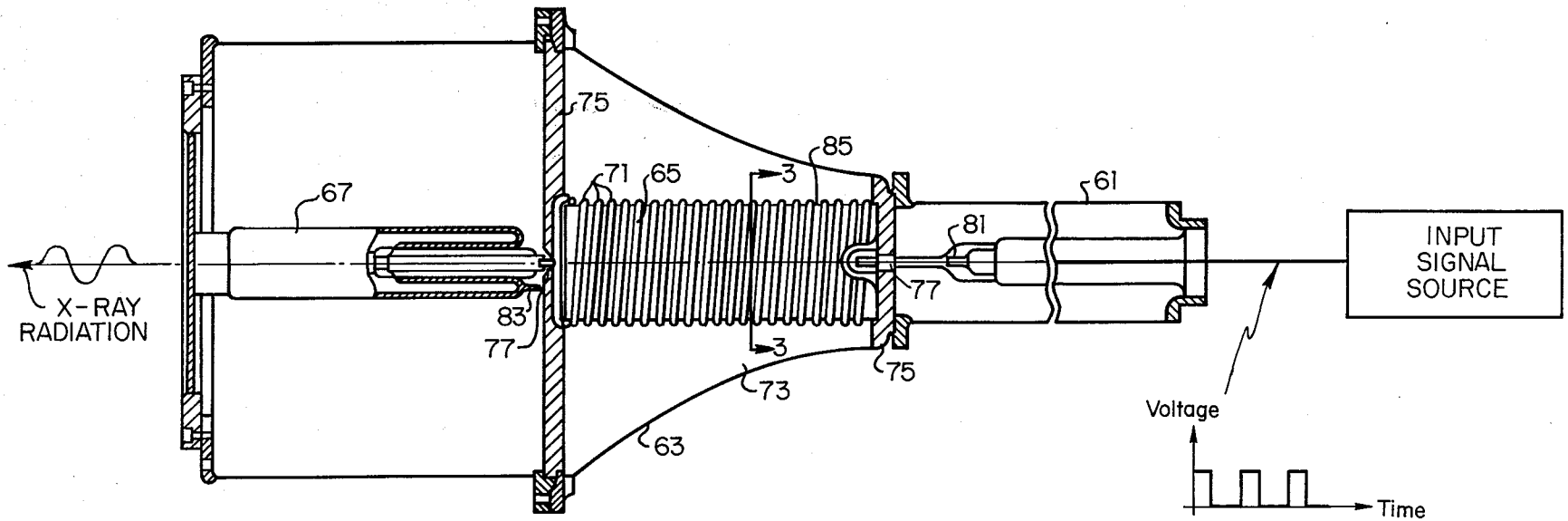
FIG. 2 is a sectional side view of another embodiment of the invention.
Figure 3:
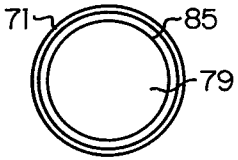
FIG. 3 is a cross sectional view taken along line 3-3 of FIG. 2.

A modified form of the x-ray tubehead, shown in FIG. 2, consists of a cable connector 61, a tubehead housing 63, a transmission line transformer 65 and an x-ray tube 67. The shape of the tubehead housing 63 has been modified to accommodate an alternative embodiment of a transmission line transformer. The cross-sectional area of the cavity formed by the electrically conductive tubehead housing 63 is increased as an exponential function of the transmission time of an applied signal along helix 71. The inner surface of housing 63 is described by the rotation of a line about a central axis of the cavity, where the distance of the line from the central axis is an exponential function of the transmission time along the helix 71. The helix 71 is coaxially aligned with the central axis of the cavity and the transmission time along an increment of the helix increases as the pitch of the windings within that increment decreases. As detailed in FIG. 3, an electro-magnetically responsive material 79 is disposed within an insulating spool 85 about which the helix 71 is wrapped. The material 79 reactively couples with helix 71 to equalize the transmission delay along helix 71 of signals having different frequencies. In addition to the impedance increase resulting from the decreasing pitch of helix 71, the increasing radius of the tubehead housing 63 increases the distance between the helix 71 and the tubehead housing 63 and further increases the impedance along the transmission line transformer 65. The additional increase in the impedance is primarily the result of the decrease in the capacitive coupling between the windings and the tubehead housing 63 as the spacing between them increases. A dielectric 73 such as transformer oil surrounds helix 71 and is contained by the tubehead housing 63 and the end plates 75. An insulated aperture 77 exists in each end plate 75 to allow the center conductor 81 of the cable connector 61 to make electrical contact through helix 71 to the anode contact 83 of the x-ray tube 67.

I claim:

1. An x-ray generator comprising:

a transmission line transformer including:

a first electrical conductor having a cavity therein;

a second electrical conductor including helical windings disposed along a longitudinal axis within the cavity in said first electrical conductor, said helical windings having a pitch which varies per unit length along said longitudinal axis;

a dielectric material disposed within the cavity in said first electrical conductor and between said first and second electrical conductors for electrically insulating said first electrical conductor from said second electrical conductor and electro-magnetically coupling said first and second electrical conductors in response to an electric current folowing through said conductors;

said first and second electrical conductors having an impedance between them which varies as a function of distance along a longitudinal axis of the helix of said second electrical conductor;

said second electrical conductor having an input terminal connected to receive an applied input signal and an output terminal for producing an output signal; and an x-ray tube disposed along the longitudinal axis within the cavity having an input coupled to said first electrical conductor and having another input coupled to the output terminal of said second electrical conductor for radiating x-rays.

2. An x-ray generator as in claim 1 comprising:

a source of said applied input signal wherein said input signal has a time-variable voltage relative to said first electrical conductor and said output signal has a timevariable voltage relative to said first electrical conductor.

3. An x-ray generator as in claim 1 wherein said:

first electrical conductor has a cavity having a cross-sectional area which varies per unit length along a longitudinal axis of the helix of said second electrical conductor.

4. An x-ray generator as in claim 1 comprising:

an element of electro-magnetically responsive material disposed within the helix of said second electrical conductor for equalizing the transmission delay along the second electrical conductor of signals having different frequencies.

5. An x-ray generator as in claim 1 wherein said:

first electrical conductor has a cavity formed by an inner surface described by the rotation of a line about a central axis of the cavity; and a central axis of the helix of said second electrical conductor is coaxially aligned with the central axis of the cavity in said first electrical conductor.

6. An x-ray generator as in claim 5 wherein said:

first electrical conductor has a cavity having a cross-sectional area which varies per unit length along the central axis of the helix of said second electrical conductor.

7. An x-ray generator as in claim 6 wherein said:

first electrical conductor has a cavity having a cross-sectional area which varies per unit length along the central axis of the helix of said second electrical conductor as an exponential function of the transmission time of an applied signal along the helix of said second electrical conductor.

* * * * *